US008781356B2

(12) United States Patent
Morita et al.

(10) Patent No.: US 8,781,356 B2
(45) Date of Patent: Jul. 15, 2014

(54) IMAGE FORMING APPARATUS AND VIBRATION REDUCING MEMBER

(75) Inventors: Keisuke Morita, Kanagawa (JP); Hideki Kuge, Kanagawa (JP); Nobumasa Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 333 days.

(21) Appl. No.: 13/367,876

(22) Filed: Feb. 7, 2012

(65) Prior Publication Data

US 2013/0071135 A1 Mar. 21, 2013

(30) Foreign Application Priority Data

Sep. 21, 2011 (JP) ..... 2011-205953

(51) Int. Cl.
*G03G 21/20* (2006.01)
*G03G 15/00* (2006.01)

(52) U.S. Cl.
USPC ..... 399/91; 399/108

(58) Field of Classification Search
USPC ..... 399/91, 107, 108, 110, 119
See application file for complete search history.

(56) References Cited

U.S. PATENT DOCUMENTS

| | | | | |
|---|---|---|---|---|
| 2007/0160383 | A1* | 7/2007 | Matsumoto et al. | 399/110 |
| 2009/0290905 | A1* | 11/2009 | Mizuno et al. | 399/111 |
| 2011/0116830 | A1* | 5/2011 | Matsui et al. | 399/107 |
| 2011/0123217 | A1* | 5/2011 | Matsui et al. | 399/107 |
| 2011/0123222 | A1* | 5/2011 | Matsui et al. | 399/111 |
| 2011/0123229 | A1 | 5/2011 | Takashima et al. | |

FOREIGN PATENT DOCUMENTS

JP 2011-107644 A 6/2011

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

An image forming apparatus includes an image forming assembly including an image carrier including a support portion and a developing device including a projecting portion, an image forming apparatus body including a frame and an assembly covering member that rotates between a closed state and an open state and that has a support hole for receiving the support portion and an interference avoiding hole for receiving the projecting portion, and a vibration reducing member. The vibration reducing member reduces vibration of the developing device relative to the image carrier by being fitted in a gap around the projecting portion in the interference avoiding hole in the state in which the projecting portion is inserted in the interference avoiding hole in the assembly covering member in the closed state. The image forming apparatus is operated in the state in which the vibration reducing member is removed.

9 Claims, 17 Drawing Sheets

IMAGE FORMING APPARATUS AND VIBRATION REDUCING MEMBER

CROSS-REFERENCE TO RELATED APPLICATIONS

This application is based on and claims priority under 35 USC 119 from Japanese Patent Application No. 2011-205953 filed Sep. 21, 2011.

BACKGROUND (i) Technical Field

The present invention relates to an image forming apparatus and a vibration reducing member.

(ii) Related Art

An image forming apparatus to which an image forming assembly may be detachably attached is known. The image forming assembly includes an image carrier, on which a latent image is formed while the image carrier is rotated and which carries a toner image formed by developing the latent image, and a developing device that is urged toward the image carrier and develops the latent image on the image carrier with toner at a position near the image carrier. In this type of image forming apparatus, when the life of the image forming assembly expires as a result of, for example, abrasion of the image carrier, the image forming assembly may be replaced with a new image forming assembly. Thus, the life of the image forming apparatus may be increased.

SUMMARY

According to an aspect of the invention, there is provided an image forming apparatus including an image forming assembly, an image forming apparatus body, and a vibration reducing member. The image forming assembly includes an image carrier on which a latent image is formed while the image carrier is rotated and which carries a toner image formed by developing the latent image, and a developing device that is urged toward the image carrier so as to be near the image carrier and develops the latent image on the image carrier with toner. The image carrier includes a support portion that is supported and that projects at a first end of the image forming assembly in a rotation-axis direction. The developing device includes a projecting portion that projects at the first end. The image forming apparatus body includes a frame into which the image forming assembly is installed in a direction such that the first end is the trailing end and that supports the image forming assembly, and an assembly covering member that is rotatably supported by the frame and that rotates between a closed state in which the assembly covering member covers the first end of the image forming assembly supported by the frame and an open state in which the first end of the image forming assembly is exposed. The assembly covering member has a support hole that receives and supports the support portion in the closed state and an interference avoiding hole that receives the projecting portion so as to avoid an interference with the projecting portion in the closed state and that is shaped such that a gap is formed along the entire periphery around the projecting portion in the closed state. The image forming apparatus body transfers the toner image formed by the image forming assembly supported by the frame onto a recording medium and fixes the toner image to the recording medium. The vibration reducing member reduces vibration of the developing device relative to the image carrier by being fitted in the gap around the projecting portion in the interference avoiding hole in the state in which the projecting portion of the image forming assembly installed in the frame is inserted in the interference avoiding hole in the assembly covering member in the closed state. The image forming apparatus is operated in the state in which the vibration reducing member is removed.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described.

Figure 1:
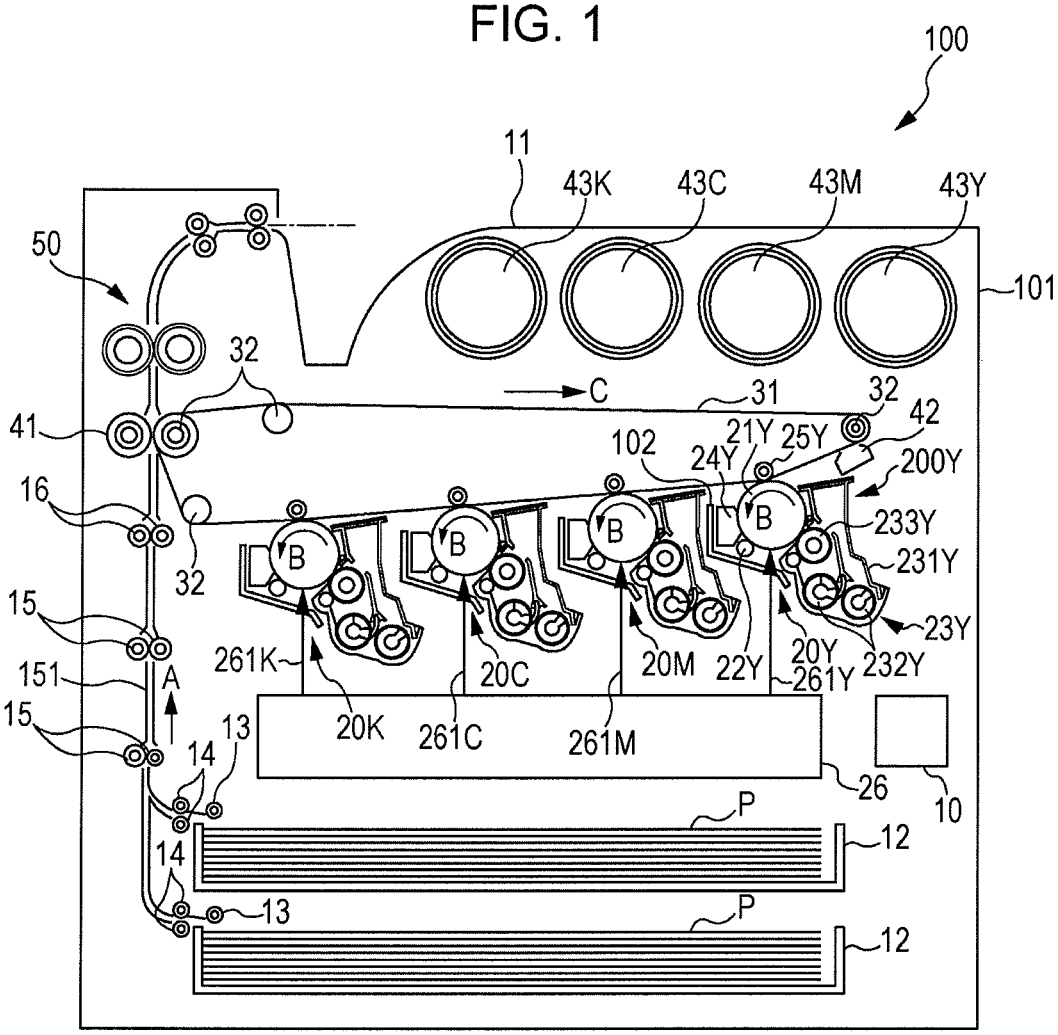
FIG. 1 is a schematic diagram of a printer, which is an example of an image forming apparatus.

FIG. 1 is a schematic diagram of a printer 100, which is an example of an image forming apparatus.

The printer 100 is surrounded by a frame 101, and a controller 10 is disposed in the frame 101. The controller 10 receives image data from a device outside the printer 100, for example, from a scanner that generates the image data by reading an image on a document or a computer that performs image processing. The controller 10 converts the image data received from the outside into image data for exposure light modulation performed by an exposure device 26, which will be described below.

In the printer 100, a paper output portion 11 to which sheets of paper are ejected after images are formed thereon is arranged in an upper section of the frame 101. Two paper feed trays 12 are arranged in a lower section of the printer 100. Sheets of paper P on which images are not yet formed are stacked on the paper feed trays 12. The paper feed trays 12 may be pulled out to allow the sheets of paper P to be supplied.

In an image forming operation, the sheets of paper P are fed from one of the paper feed trays 12 by a corresponding pick-up roller 13, and are separated from each other by corresponding separation rollers 14. One of the sheets of paper P is transported upward in the direction shown by arrow A by transport rollers 15 along a transport path 151, and is further transported upward after the time at which the sheet of paper P is further transported is adjusted by standby rollers 16. The process of transporting the sheet of paper P further downstream from the standby rollers 16 will be described below.

Four image forming engines 20Y, 20M, 20C, and 20K are arranged at a substantially central area of the printer 100 in the vertical direction. The image forming engines 20Y, 20M, 20C, and 20K form toner images using toners of respective colors, which are yellow (Y), magenta (M), cyan (C), and black (K). The four image forming engines 20Y, 20M, 20C, and 20K have the same structure, and thus the structure of the image forming engine 20Y will be described as an example.

The image forming engine 20Y includes a photoconductor 21Y that rotates in the direction shown by arrow B in FIG. 1. A charging device 22Y, a developing device 23Y, and a cleaner 24Y are arranged around the photoconductor 21Y. The unit including the photoconductor 21Y and the developing device 23Y, and also including the charging device 22Y and the cleaner 24Y in the present exemplary embodiment form an image forming unit 200Y. The image forming unit 200Y is detachably attached to the frame 101 by being slid in a rotation-axis direction while being guided along an attachment guide portion 102 fixed to the frame 101. The image forming unit 200Y is an example of an image forming assembly according to an exemplary embodiment of the present invention. The developing device 23Y includes a developing roller 233Y that is urged toward the photoconductor 21Y by springs. The developing roller 233Y is pressed toward the photoconductor 21Y with a spacer (not shown) provided therebetween, so that a predetermined gap is provided between the developing roller 233Y and the photoconductor 21Y.

A transfer device 25Y is disposed at a position where an intermediate transfer belt 31, which will be described below, is interposed between the photoconductor 21Y and the transfer device 25Y.

The photoconductor 21Y is roll shaped. The photoconductor 21Y is charged with electricity in a charging process, and then releases the electric charges in an exposure process, so that an electrostatic latent image is formed on the surface thereof. The photoconductor 21Y is an example of an image carrier according to an exemplary embodiment of the present invention.

The charging device 22Y charges the surface of the photoconductor 21Y to a predetermined charge potential.

The exposure device 26 emits exposure light 261Y that is modulated in accordance with the input image data. The photoconductor 21Y is charged by the charging device 22Y, and is then irradiated with the exposure light 261Y emitted from the exposure device 26. As a result, an electrostatic latent image is formed on the surface of the photoconductor 21Y.

After the photoconductor 21Y is irradiated with the exposure light 261Y and the electrostatic latent image is formed on the surface thereof, the electrostatic latent image is developed by the developing device 23Y. As a result, a toner image, which is a toner image formed by yellow (Y) toner in the image forming engine 20Y, is formed on the surface of the photoconductor 21Y.

The developing device 23Y includes two augers 232Y and a developing roller 233Y that are disposed in a casing 231Y that contains developer including toner and carrier. The augers 232Y are configured to stir the developer, and the developing roller 233Y transports the developer to the position where the developing roller 233Y faces the photoconductor 21Y. To develop the electrostatic latent image formed on the photoconductor 21Y, a bias voltage is applied to the developing roller 233Y. Owing to the bias voltage, the toner in the developer adheres to the photoconductor 21Y in areas corresponding to the electrostatic latent image formed on the photoconductor 21Y. Thus, a toner image is formed.

The toner image formed on the photoconductor 21Y as a result of the developing process performed by the developing device 23Y is transferred onto the intermediate transfer belt 31 by the transfer device 25Y.

The toner that remains on the photoconductor 21Y after the transfer process is removed from the photoconductor 21Y by the cleaner 24Y.

The intermediate transfer belt 31 is an endless belt that is stretched around plural rolls 32 and that rotates in the direction shown by arrow C.

Toner images of respective colors are formed by the image forming engines 20Y, 20M, 20C, and 20K, successively transferred onto the intermediate transfer belt 31 in a superimposed manner, and transported to a second transfer position at which a second transfer device 41 is disposed. In synchronization with this process, the sheet of paper that has been transported to the standby rollers 16 is transported to the second transfer position, and the toner images on the intermediate transfer belt 31 are transferred onto the sheet of paper by the second transfer device 41. The sheet of paper onto which the toner images have been transferred is further transported to a fixing device 50, which applies pressure and heat to the sheet of paper to fix the toner images to the sheet of paper. Thus, a fixed toner image is formed on the sheet of paper P. The sheet of paper on which the image is formed is further transported and ejected to the paper output portion 11.

After the toner images are transferred onto the sheet of paper by the second transfer device 41, the intermediate transfer belt 31 is further rotated and the toner that remains on the surface of the intermediate transfer belt 31 is removed therefrom by a cleaner 42.

Toner containers 43Y, 43M, 43C, and 43K that contain the toners of respective colors are arranged above the intermediate transfer belt 31. The toners of respective colors contained in the toner containers 43Y, 43M, 43C, and 43K are supplied to the developing devices, such as the developing device 23Y, included in the image forming engines 20Y, 20M, 20C, and 20K as the toners in the developing devices are consumed.

Figure 2:
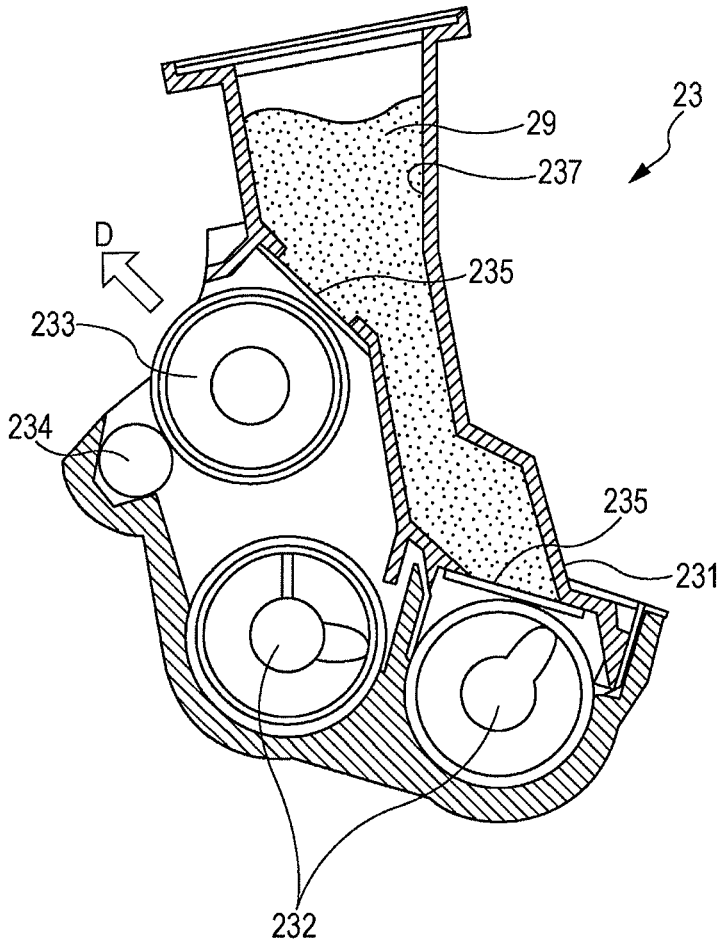
FIG. 2 is a schematic diagram of a developing device included in the printer illustrated in FIG. 1.

FIG. 2 is a schematic diagram of one of the developing devices included in the printer illustrated in FIG. 1.

In the above description, the image forming engine 20Y which uses the yellow (Y) toner is explained as an example with reference to FIG. 1, and accordingly the developing device is denoted by 23Y. However, in FIG. 2 and the following figures, the characters Y, M, C, and K representing the colors used to distinguish the components of the image forming engines 20Y, 20M, 20C, and 20K from each other are omitted unless they are to be distinguished. For example, the developing device is denoted by 23. This also applies to other components.

As described above, the developing device 23 includes the two augers 232 and the developing roller 233 that are disposed in the casing 231. The augers 232 are configured to stir the developer, and the developing roller 233 transports the developer to the position where the developing roller 233 faces the photoconductor 21 (see FIG. 1). The developing device 23 also includes a member 234 for regulating the thickness of a developer layer retained on the developing roller 233. In FIG. 2, only the developing device 23 included in the image forming unit, which also includes the photoconductor 21 (see FIG. 1), is illustrated. Although not illustrated in FIG. 2, the developing device 23 is urged by springs 201 (see FIG. 5) in the direction shown by arrow D, that is, toward the photoconductor, in the image forming unit. The distance between the developing device 23 and the photoconductor is maintained at a certain distance by a spacer (not shown). The developing device 23 includes a developer chamber 237 in which developer 29 is enclosed when the developing device 23 is new and not yet used. When the image forming unit 200 including the developing device 23 is new and not yet used, the developer chamber 237 contains the developer 29 including the toner and carrier and is sealed with two sealing films 235 so that the developer 29 does not enter the chamber in which the augers 232 and the developing roller 233 are arranged. With this structure, leakage of the developer 29 is prevented even when a new image forming unit is dropped or subjected to stress, such as vibration or impact, while being transported.

The sealing films 235 are pulled out after the image forming unit including the developing device 23 is installed into the printer 100. Accordingly, the developer 29 enters the chamber in the casing 231 in which the augers 232 and the developing roller 233 are arranged. Thus, the developing device 23 is set to an operable state. The toner included in the developer contained in the developing device 23 is consumed in the developing process, and an amount of toner that corresponds to the amount of consumption thereof is supplied from the toner container 43 (see FIG. 1).

The developer 29 may be sealed by the sealing films 235 when the image forming unit is carried by itself. However, when the printer 100 is transported while the image forming unit is installed therein, the following problem occurs. That is, a final operation test is performed before the printer 100 is shipped by the manufacturer. In the operation test, the sealing films 235 are removed from the developing device 23 to operate the developing device 23 in practice. When the printer 100 passes the operation test, the printer 100 is transported to the user. In this case, if, for example, the printer 100 is to be transported while the developer 29 is enclosed in the developer chamber 237 in the developing device 23, the image forming unit used in the operation test cannot be left installed in the printer 100. Instead, the printer 100 is transported after the image forming unit 200 is removed and another image forming unit 200 including the developing device 23 in which the developer 29 is sealed with the sealing films 235 is installed in the printer 100. In this case, although the image forming unit used in the operation test may be used plural times, waste inevitably occurs. In addition, a cumbersome procedure is performed to prepare for transportation of the printer 100, which leads to an increase in cost.

If the printer 100 is transported in the state in which the developer 29 is not enclosed in the developer chamber 237 after the operation test, the following problem occurs. That is, since the developing device 23 is urged toward the photoconductor by the springs as described above, the developing device 23 vibrates while the printer 100 is being transported. Owing to the vibration of the developing device 23, there is a high risk that the developer leaks through gaps between components that form the casing 231 of the developing device 23. If the developer leaks out of the developing device 23, the inside of the printer 100 may be stained, which is a serious problem.

Accordingly, in the present exemplary embodiment, a vibration reducing member, which will be described below, is used. The vibration reducing member is used when the printer 100 is transported, and is removed after the printer 100 is transported and before the printer 100 is operated. Accordingly, the printer 100 may be transported in the state in which the image forming unit 200 used in the operation test before shipping is attached, without causing the inside of the printer 100 to be stained with the developer. In the present exemplary embodiment, the image forming unit used in the final operation test before shipping is the same as the image forming unit used by the user. Therefore, abnormality detection may be performed before shipping.

Figure 3:
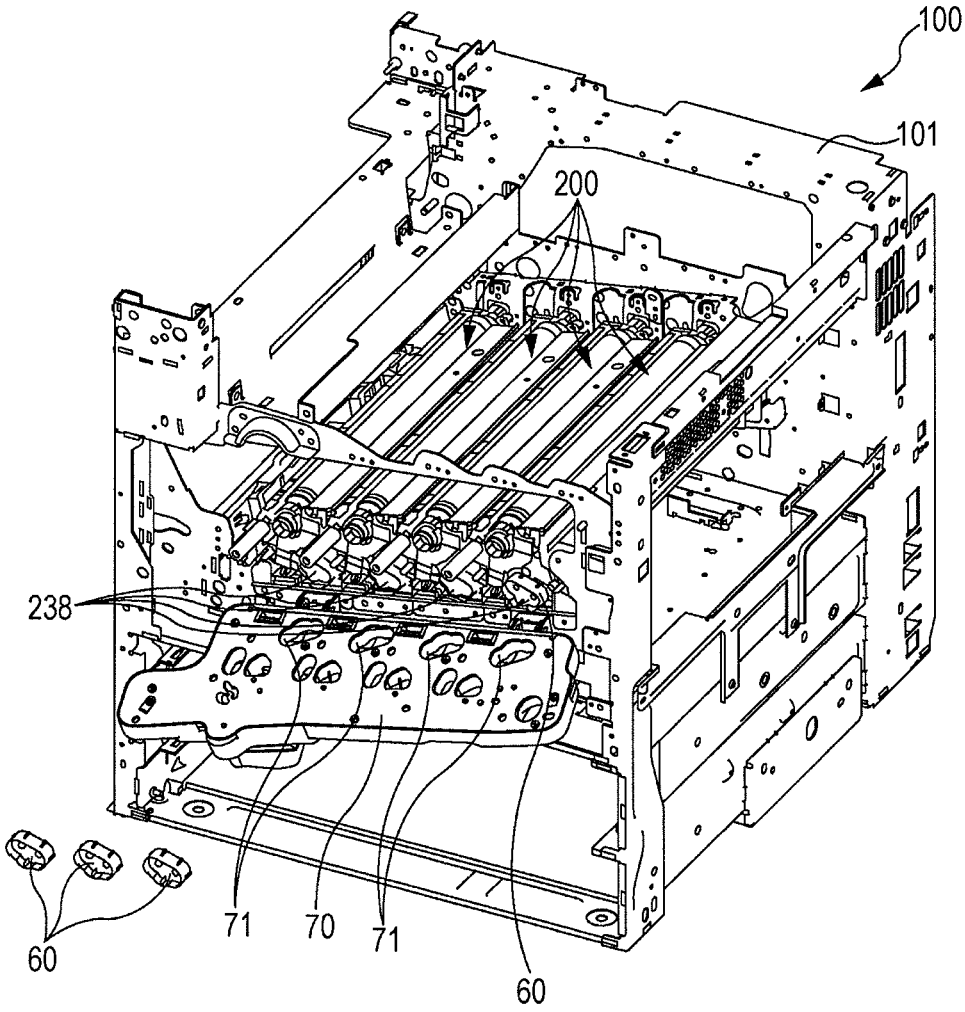
FIG. 3 illustrates the state in which four image forming units are installed in a frame of the printer having the structure illustrated in FIG. 1.
Figure 4:
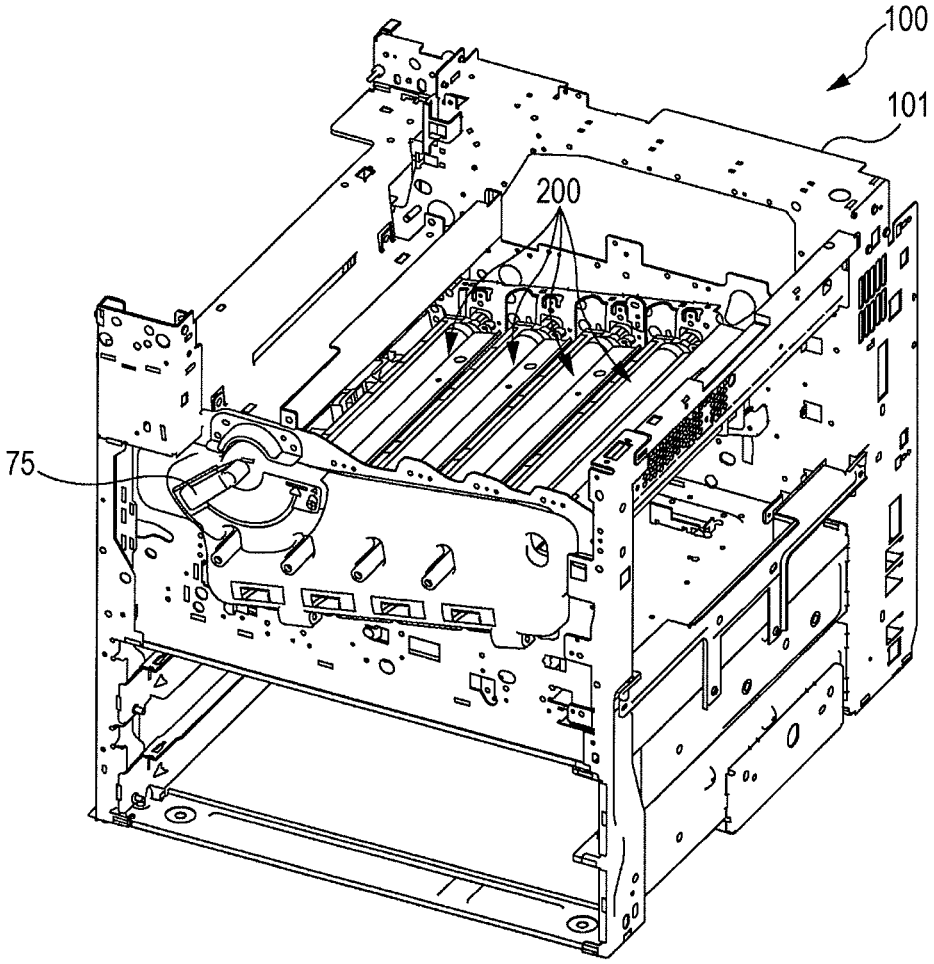
FIG. 4 illustrates the state in which the four image forming units are installed in the frame of the printer having the structure illustrated in FIG. 1.

FIGS. 3 and 4 are diagrams illustrating the state in which the four image forming units 200 are installed in the frame 101 in the printer 100 having the structure illustrated in FIG. 1. A front covering 70 is in an open state in FIG. 3, and is in a closed state in FIG. 4.

The four image forming units 200 are detachably attached to the frame 101 of the printer 100 by being slid in the rotation-axis direction at positions along the four attachment guide portions 102 (see FIG. 1). Referring to FIG. 1, each image forming unit 200 includes the photoconductor 21, the charging device 22, the developing device 23, and the cleaner 24 illustrated in FIG. 1.

Each developing device 23 has a projecting portion 238 at a front end thereof (end at the side illustrated in FIGS. 3 and 4). Each projecting portion 238 is a part in which a driving-force transmitting gear for the two augers 232 is covered with a covering so that the gear is not exposed. When the printer 100 is transported, a cap 60 is fitted to each projecting portion 238. The printer 100 includes a front covering 70 that covers the front ends of the image forming units 200 installed in the frame 101. The front covering 70 has interference avoiding holes 71 so that the front covering 70 does not interfere with the projecting portions 238. The front covering 70 is supported on the frame 101 so as to be rotatable between a closed state (see FIG. 4) in which the front covering 70 covers the front ends of the image forming units 200 and an open state (see FIG. 3) in which the front ends of the image forming units 200 are exposed. When the front covering 70 is rotated from the open state to the closed state while the caps 60 are fitted to the projecting portions 238 at the front ends of the developing devices 23 in the image forming units 200, the projecting portions 238 are inserted into the interference avoiding holes 71 together with the caps 60 fitted to the projecting portions 238.

The caps 60 are examples of a vibration reducing member according to an exemplary embodiment of the present invention, and the front covering 70 is an example of an assembly covering member according to an exemplary embodiment of the present invention.

Figure 5:
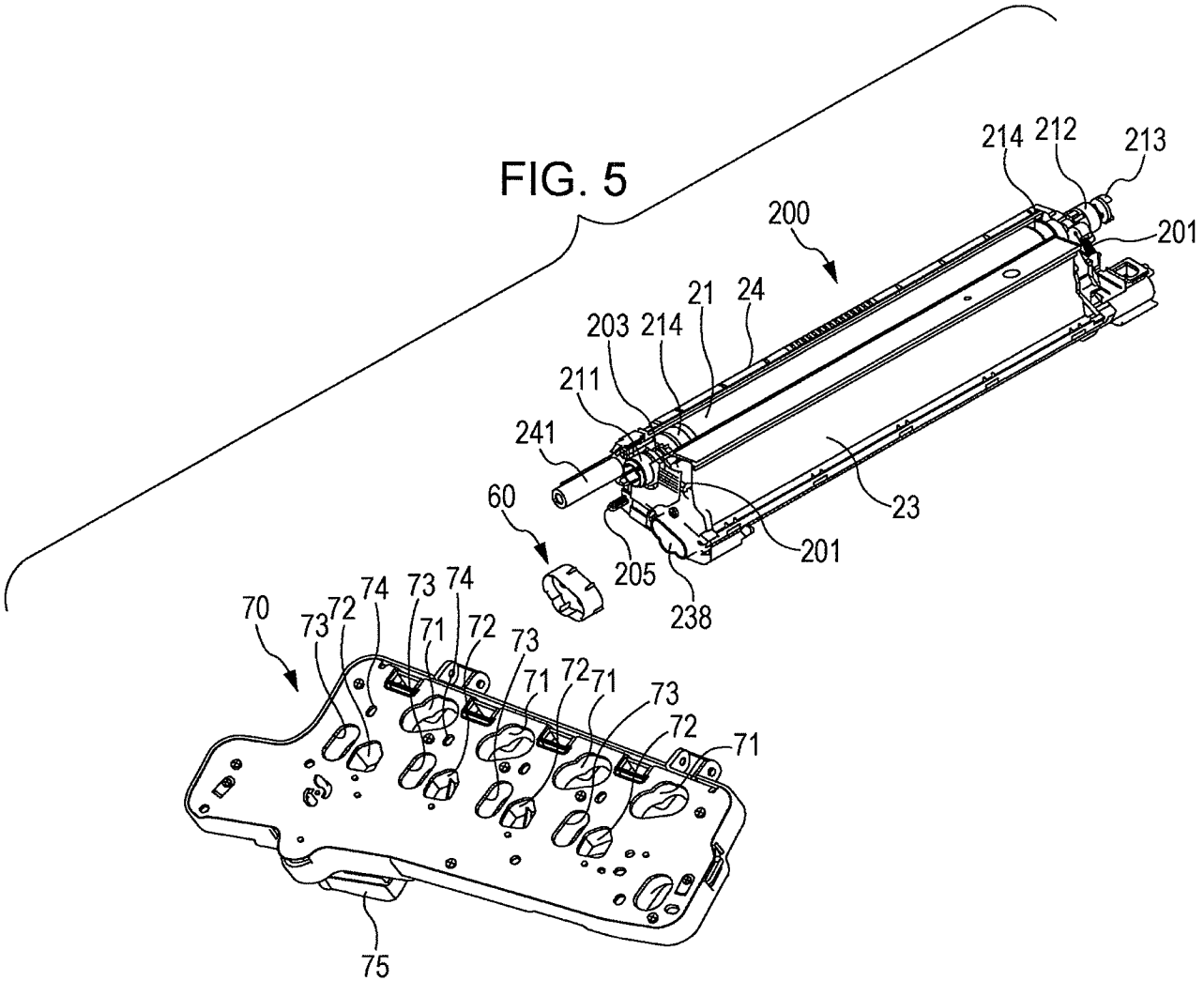
FIG. 5 is a perspective view illustrating the positional relationship between an image forming unit, a cap, and a front covering when the front covering is opened or closed.
Figure 6:
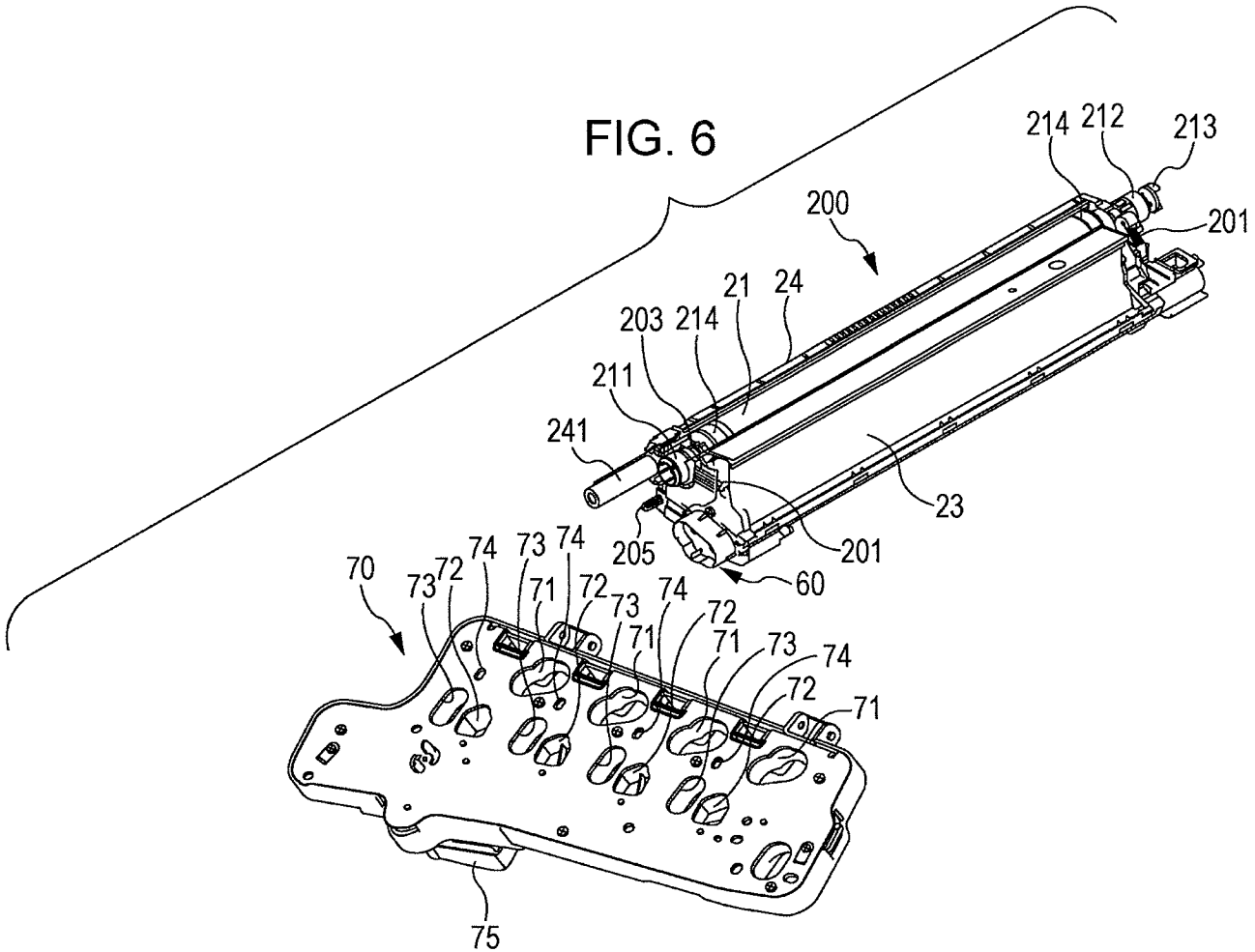
FIG. 6 is a perspective view illustrating the positional relationship between the image forming unit, the cap, and the front covering when the front covering is opened or closed.
Figure 7:
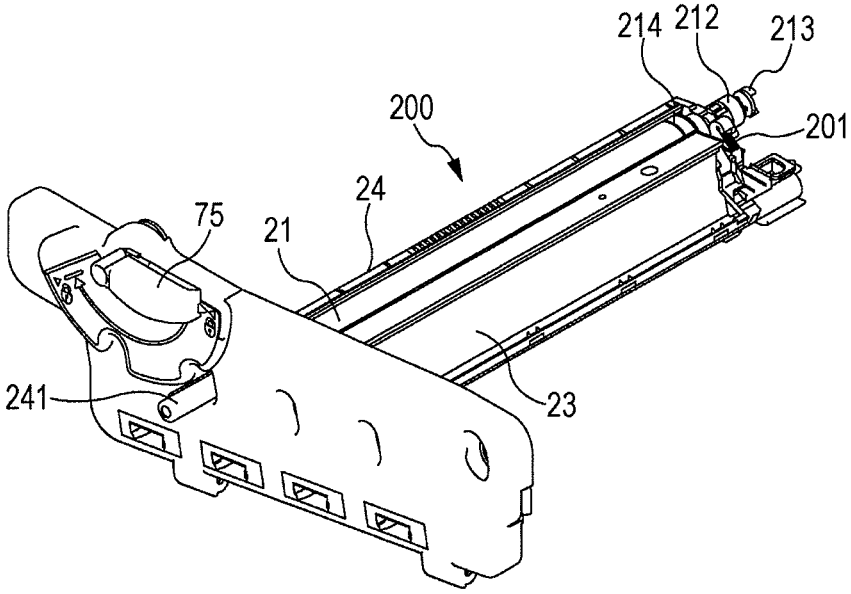
FIG. 7 is a perspective view illustrating the positional relationship between the image forming unit, the cap, and the front covering when the front covering is opened or closed.

FIGS. 5 to 7 are perspective views illustrating the positional relationship between the image forming unit 200, the cap 60, and the front covering 70 when the front covering 70 is opened or closed. Only one of the image forming units 200 is illustrated in FIGS. 5 to 7.

The image forming unit 200 includes the photoconductor 21, the developing device 23, and the cleaner 24, as illustrated in FIG. 5. In addition, although not illustrated in FIG. 5, the image forming unit 200 also includes the charging device 22 (see FIG. 1).

A bearing 211 projects from the photoconductor 21 at the front end thereof. The bearing 211 is inserted into a bearing support hole 72 formed in the front covering 70 and is rotatably supported by the front covering 70. Another bearing 212 is provided near the back end of the photoconductor 21, and is supported by a support member (not shown) that supports the back end of the photoconductor 21. A coupling 213 is provided at a position closer to the back end of the photoconductor 21 than the bearing 212. The photoconductor 21 is configured to receive a driving force from a motor (not shown) through the coupling 213. In addition, the developing device 23 has the structure described above with reference to FIG. 2. The developing roller 233 (see FIG. 2) is urged and pressed toward the photoconductor 21 by the springs 201 provided at the front and back ends of the developing roller 233. Of the springs 201 at the front and back ends, the spring 201 at the front end is positioned behind a lever 203 used to install or remove the image forming unit 200. Tracking-roller contact portions 214 are provided at both ends of the photoconductor 21. The developing roller 233 is pressed toward the tacking-roller contact portions 214 with spacers (tracking rollers), which are not shown, provided therebetween. A predetermined gap is provided between the developing roller 233 and the photoconductor 21 in an effective area between the tacking-roller contact portions 214. A driving force is transmitted form a motor (not shown) to the developing device 23 through gears. A gear configured to transmit the driving force that has been transmitted to one of the two augers 232 to the other is arranged at the front end. The projecting portion 238 at the front end of the developing device 23 is formed by covering the gear at the front end. The cleaner 24 includes a discharge cylinder 241 that projects forward. The toner that remains on the photoconductor 21 after the transfer process is removed by the cleaner 24. The toner removed from photoconductor 21 is transported to the discharge cylinder 241, and is guided to a waste toner tank (not shown) through a discharge port (not shown) in the discharge cylinder 241. The discharge cylinder 241 extends through a toner discharge opening 73 in the front covering 70.

A positioning pin 205 projects from the image forming unit 200 at the front end thereof. The positioning pin 205 is inserted into a positioning hole 74 formed in the front covering 70. Although the front covering 70 has various other holes in addition to the above-described holes and openings, such holes are not explained herein since they are irrelevant to the characteristic part of the present exemplary embodiment. An operation lever 75 that is operated to open or close the front covering 70 is provided at the front surface of the front covering 70 in the closed state (see FIGS. 4 and 7).

FIG. 5 illustrates the cap 60 in the state in which the cap 60 is removed from the projecting portion 238. The cap 60 will be described in detail below. FIG. 6 illustrates the cap 60 in the state in which the cap 60 is fitted to the projecting portion 238. FIG. 7 illustrates the state in which the front covering 70 is rotated to the closed state while the cap 60 is fitted to the projecting portion 238. In this state, the projecting portion 238 is inserted in the corresponding interference avoiding hole 71 while the cap 60 is fitted thereto.

Figure 8:
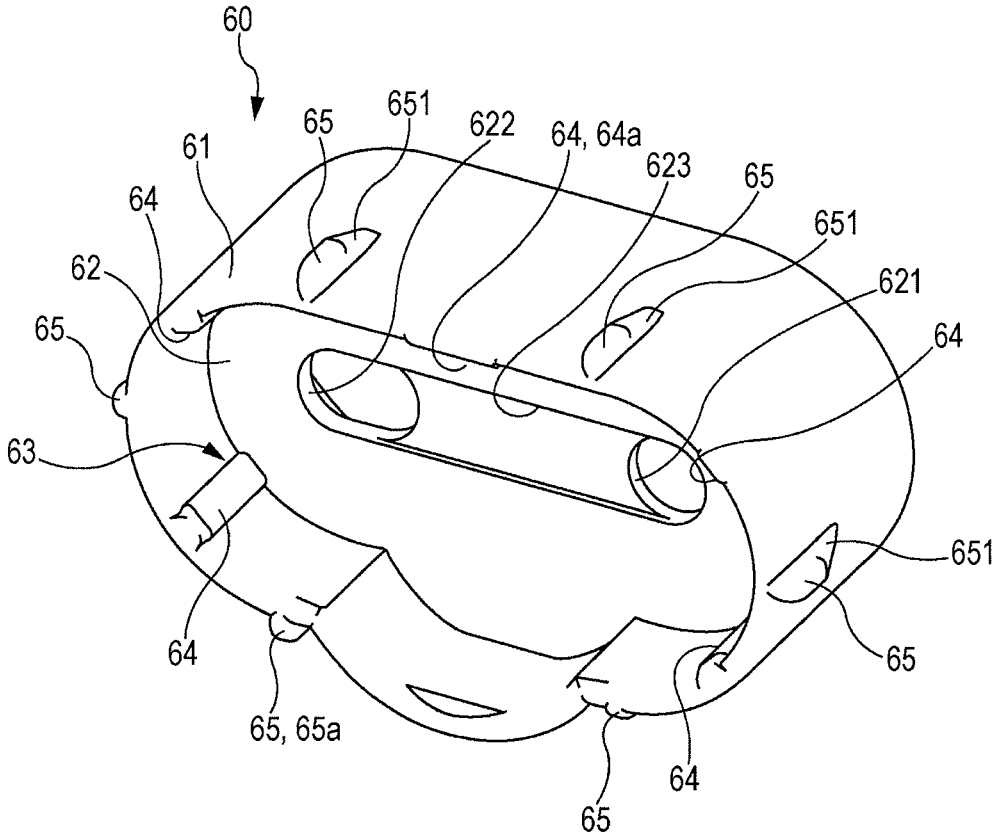
FIG. 8 is a perspective view of the cap viewed from the side of a projecting portion to which the cap is fitted.
Figure 9:
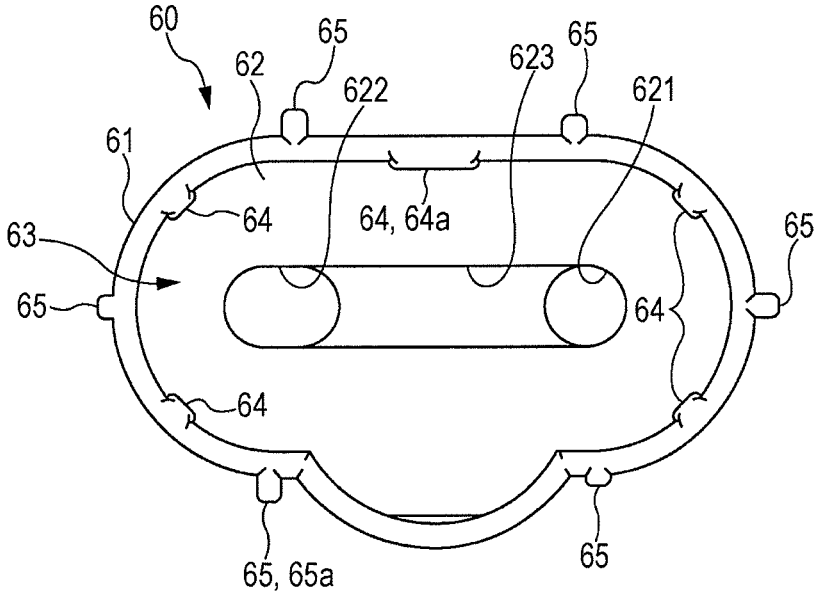
FIG. 9 is a front view of the cap whose perspective view is shown in FIG. 8, viewed from the side of the projecting portion to which the cap is fitted.
Figure 10:
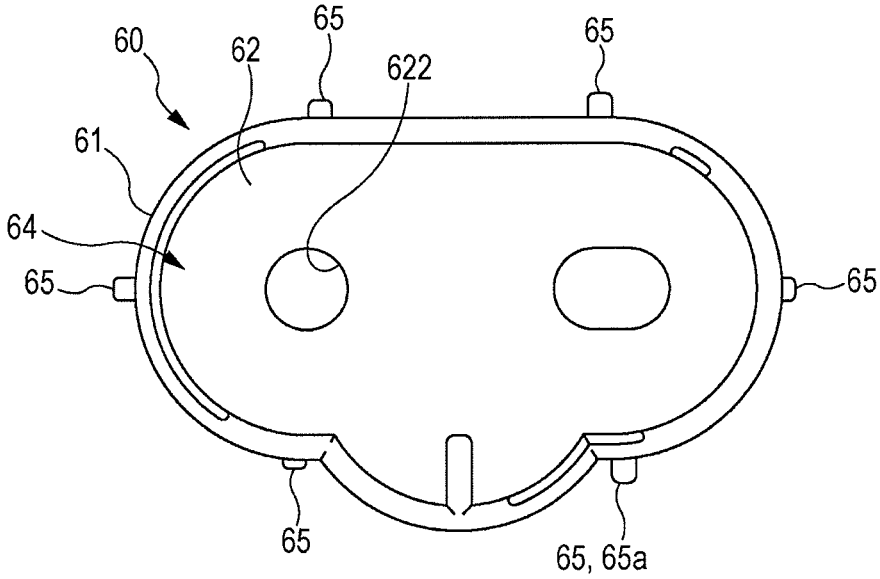
FIG. 10 is a front view of the cap whose perspective view is shown in FIG. 8, viewed from the side opposite to that in FIG. 9.
Figure 11:
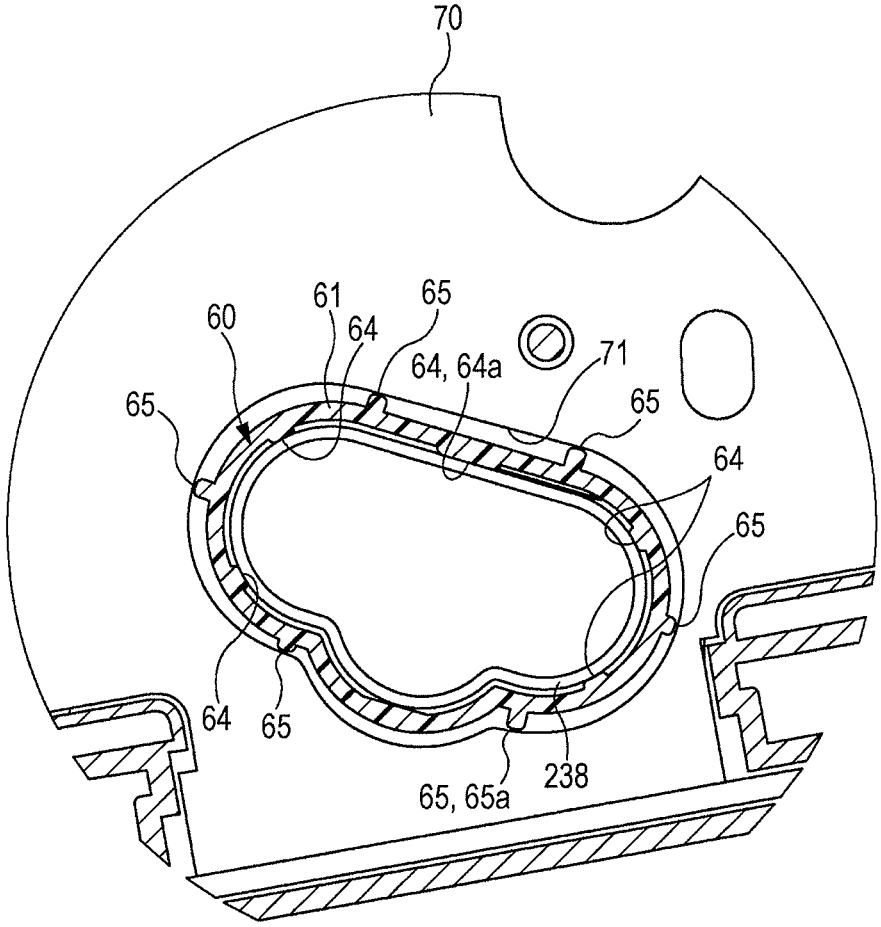
FIG. 11 is a sectional view illustrating the state in which the cap is fitted to the projecting portion and inserted into an interference avoiding hole in the front covering.

FIG. 8 is a perspective view of the cap 60 viewed from the side of the projecting portion 238 to which the cap 60 is fitted. FIG. 9 is a front view of the cap 60 whose perspective view is shown in FIG. 8, viewed from the side of the projecting portion 238 to which the cap 60 is fitted. FIG. 10 is a front view of the cap 60 viewed from the side opposite to that in FIG. 9. In addition, FIG. 11 is a sectional view illustrating the state in which the cap 60 is fitted to the projecting portion 238 and inserted into the interference avoiding hole 71 in the front covering. As described above, the cap 60 is an example of a vibration reducing member according to an exemplary embodiment of the present invention.

When the projecting portion 238 of the developing device 23 in the image forming unit 200 that is installed into the printer 100 is inserted into the interference avoiding hole 71 in the front covering 70 in the closed state, the cap 60 is fitted into a gap around the projecting portion 238 in the interference avoiding hole 71. Thus, the cap 60 serves to reduce the vibration of the developing device 23 relative to the photoconductor 21.

As described above, the developing device 23 is urged toward the photoconductor 21 by the springs 201 (see FIG. 5). The bearing 211 at the front end of the photoconductor 21 is supported in the bearing support hole 72, and the bearing 212 at the back end of the photoconductor 21 is supported by the support member (not shown). Thus, the photoconductor 21 is rotatably supported by the frame 101. The size of the interference avoiding hole 71 that is formed in the front covering 70 to receive the projecting portion 238 of the developing device 23 is set to be relatively large. Accordingly, the developing device 23 urged by the springs 201 is movable in response to the rotation of the photoconductor 21, and no interference occurs even when there are dimensional differences between the image forming units 200. Therefore, when vibration is externally applied, the developing device 23 vibrates relative to the photoconductor 21. If the developing device 23 is largely vibrated, there is a risk that the developer in the developing device 23 will scatter. The vibration is particularly strong when the printer 100 is transported, and there is a high risk that the developer will scatter unless a suitable countermeasure is taken.

In the present exemplary embodiment, vibration of the developing device 23 is reduced by fitting the cap 60 into the gap around the projecting portion 238 in the interference avoiding hole 71. As a result, scattering of the developer is suppressed. After the printer 100 is transported, the front covering 70 is opened and the cap 60 is removed from the projecting portion 238 before the printer 100 is used.

The cap 60 is resin-molded and includes a cylindrical portion 61 that surrounds the periphery of the projecting portion 238 of the developing device 23 and a partition plate 62 that divides the inner space of the cylindrical portion 61 at an intermediate position thereof. The projecting portion 238 of the developing device 23 is fitted into a recess 63 surrounded by the cylindrical portion 61 and the partition plate 62 at the side illustrated in FIGS. 8 and 9.

Two holes 621 and 622 are formed in the partition plate 62. These holes 621 and 622 are used to attach the cap 60 to a test jig (not shown) when the cap 60 is subjected to a dimensional inspection after the cap 60 is manufactured. Detailed explanation of the holes 621 and 622 will be omitted. A groove 623 that connects the two holes 621 and 622 to each other is formed in a surface of the partition plate 62 at the side of the recess 63 illustrated in FIGS. 8 and 9. When the cap 60 is fitted to the projecting portion 238 of the developing device 23, a string may be inserted through the two holes 621 and 622 in advance. In this case, the cap 60 fitted to the projecting portion 238 may be removed from the projecting portion 238 by pulling the string. The groove 623 that connects the two holes 621 and 622 to each other is provided to prevent the string inserted through the two holes 621 and 622 in advance from interfering with the projecting portion 238 when the cap 60 is fitted to the projecting portion 238. Accordingly, the cap 60 may be properly fitted to the projecting portion 238.

The cylindrical portion 61 of the cap 60 is an example of a base portion according to an exemplary embodiment of the present invention. Referring to FIG. 11, in the state in which the projecting portion 238 of the developing device 23 is inserted in the interference avoiding hole 71 formed in the front covering 70, the cylindrical portion 61 surrounds the entire periphery of the projecting portion 238 in such a manner that the cylindrical portion 61 is separated from wall surfaces of both the projecting portion 238 and the interference avoiding hole 71 in the gap around the projecting portion 238. The cap 60 includes inner ribs 64 that project inward from the cylindrical portion 61 toward the projecting portion 238 and outer ribs 65 that project outward from the cylindrical portion 61 toward the wall surface of the interference avoiding hole 71. The inner ribs 64 include a wide rib 64*a* depending on the position at which the projecting portion 238 is restrained. The outer ribs 65 include a rib 65*a* that projects by a large amount depending on the distance to the wall surface of the interference avoiding hole 71. The cap 60 is not shaped so as to completely fill the gap around the projecting portion 238 in the interference avoiding hole 71, but is shaped such that the inner ribs 64 and the outer ribs 65 project from the cylindrical portion 61, as illustrated in FIGS. 8 to 11. Therefore, the cap 60 may be fitted to and removed from the projecting portion 238 with a small force, and the front covering 70 may be opened and closed with a small force.

The amount of projection of the inner ribs 64 is set so that the projecting portion 238 may be softly restrained at the periphery thereof. The amount of projection of the outer ribs 65 is set so as to allow a movement of the cap 60 in the interference avoiding hole 71. The outer ribs 65 are narrower than the inner ribs 64 when viewed in the direction along the rotational axis of, for example, the photoconductor 21, that is, when viewed in the direction illustrated in FIGS. 9 to 11. The above-described configuration is employed so that the projecting portion 238 may be effectively retained and the front covering 70 may be opened and closed with a small force.

Each outer rib 65 on the cap 60 has an inclined portion 651 at an end that is opposed to the front covering 70 when the front covering 70 is rotated from the open state to the closed state while the cap 60 is fitted to the projecting portion 238, that is, at the back end in FIG. 8. The inclined portion 651 is inclined in a manner such that the amount of projection from the cylindrical portion 61 decreases toward the end. The position and inclination of each inclined portion 651 are determined so that the outer ribs 65 do not come into contact with the wall surface of the interference avoiding hole 71 before the bearing 211 of the photoconductor 21 comes into contact with a wall surface of the bearing support hole 72 in the front covering 70 when the front covering 70 is rotated from the open state to the closed state.

The bearing 211 of the photoconductor 21 is supported in the bearing support hole 72 in the front covering 70. Therefore, when the front covering 70 is closed, the bearing 211 comes into contact with the wall surface of the bearing support hole 72 and the front covering 70 is rotated with a relatively strong force. In the state before the bearing 211 of the photoconductor 21 is supported in the bearing support hole 72 in the front covering 70, the photoconductor 21 is supported only at the back end thereof. Accordingly, the front end of the photoconductor 21 is displaced somewhat downward due to the gravity. Therefore, the front end of the developing device 23, which is urged toward the photoconductor 21 by the springs 201, is also displaced downward. Accordingly, if the cap 60 fitted to the projecting portion 238 of the developing device 23 is inserted into the interference avoiding hole 71 before the bearing 211 of the photoconductor 21 is supported in the bearing support hole 72 in the front covering 70, the cap 60 comes into contact with the wall surface of the interference avoiding hole 71. In this case, when the front covering 70 is closed, the contact between the interference avoiding hole 71 and the cap 60 and the contact between the bearing support hole 72 and the bearing 211 may occur at the same time. In such a case, the front covering 70 cannot be closed unless a strong force is applied.

According to the present exemplary embodiment, each of the outer ribs 65 on the cap 60 includes the inclined portion 651, so that the outer ribs 65 are prevented from coming into contact with the wall surface of the interference avoiding hole 71 before the bearing 211 comes into contact with the wall surface of the bearing support hole 72. This also allows the front covering 70 to be closed with a small force.

FIGS. 12 to 18 are diagrams illustrating the positional relationship between the cap 60 and the interference avoiding hole 71 and the positional relationship between the bearing 211 of the photoconductor 21 and the bearing support hole 72 when the front covering 70 is closed.

Figure 12:
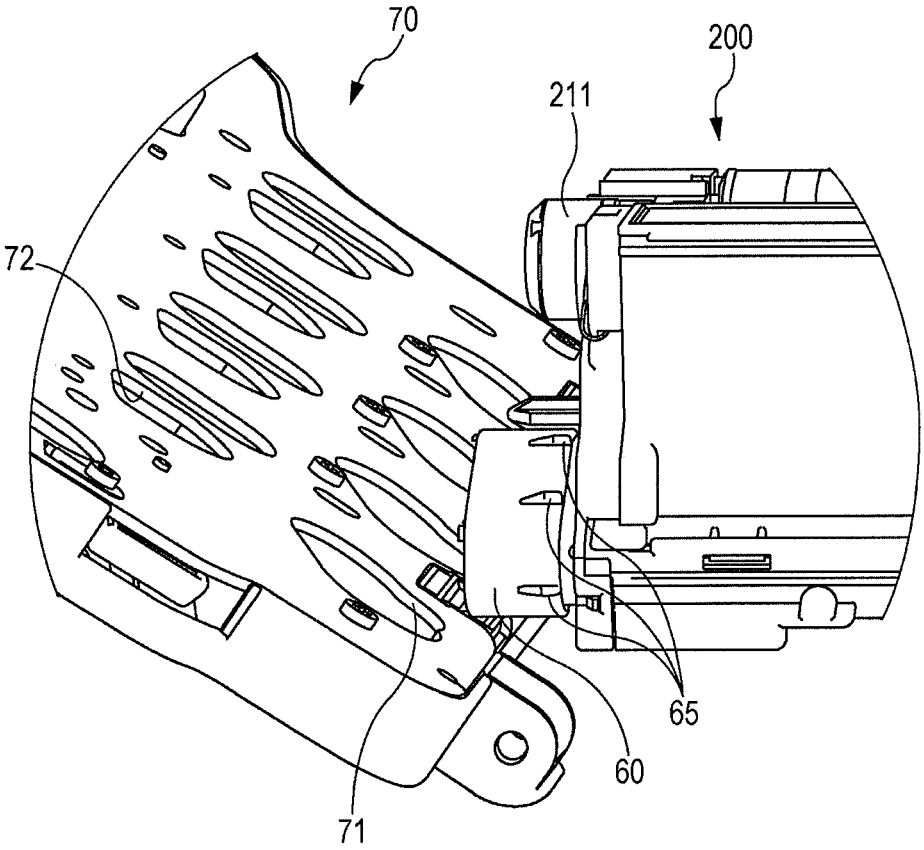
FIG. 12 illustrates the positional relationship between the cap and the interference avoiding hole and the positional relationship between a bearing of a photoconductor and a bearing support hole when the front covering is being closed.

FIG. 12 illustrates the state in which the front covering 70 is about to be closed. The cap 60 and the interference avoiding hole 71 are separated from each other, and the bearing 211 and the bearing support hole 72 are separated from each other.

Figure 13:
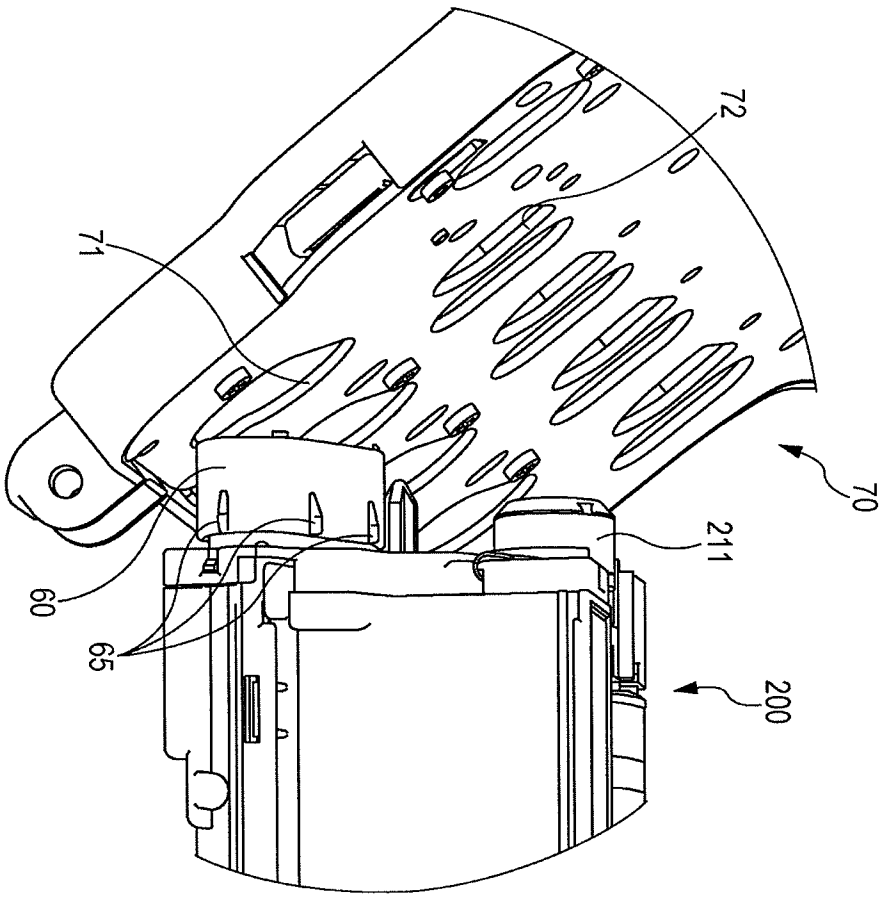
FIG. 13 illustrates the positional relationship between the cap and the interference avoiding hole and the positional relationship between the bearing of the photoconductor and the bearing support hole when the front covering is being closed.

FIG. 13 illustrates the state in which the lower part of the cap 60 starts to enter the interference avoiding hole 71. In this state, the cap 60 is not in contact with the wall surface of the interference avoiding hole 71.

Figure 14:
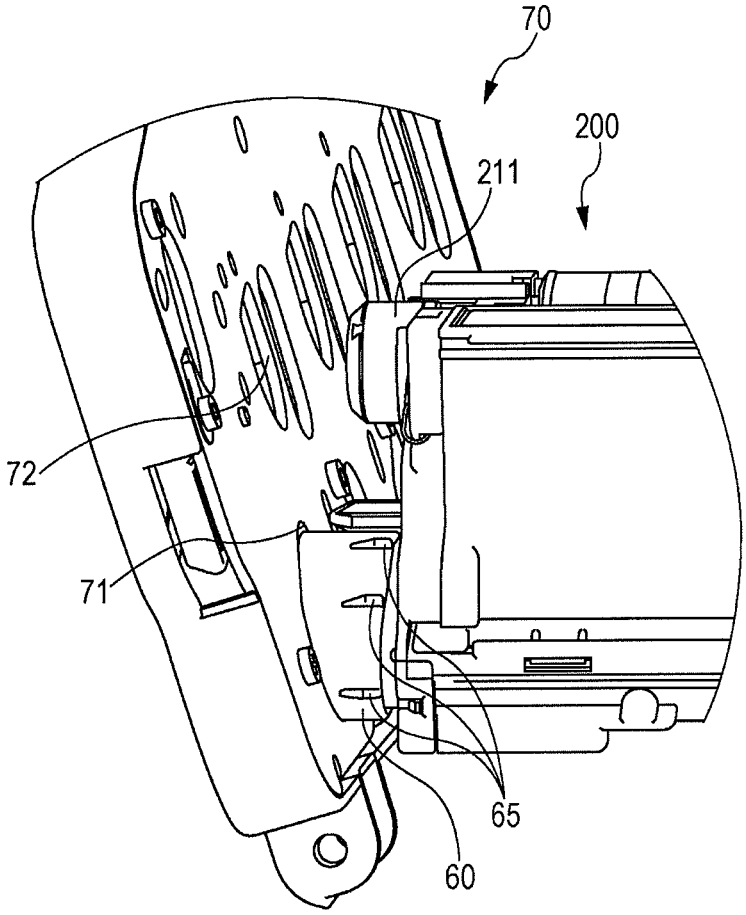
FIG. 14 illustrates the positional relationship between the cap and the interference avoiding hole and the positional relationship between the bearing of the photoconductor and the bearing support hole when the front covering is being closed.

FIG. 14 illustrates the state in which the upper part of the cap 60 starts to enter the interference avoiding hole 71. Also in this state, the cap 60 is not in contact with the wall surface of the interference avoiding hole 71.

Figure 15:
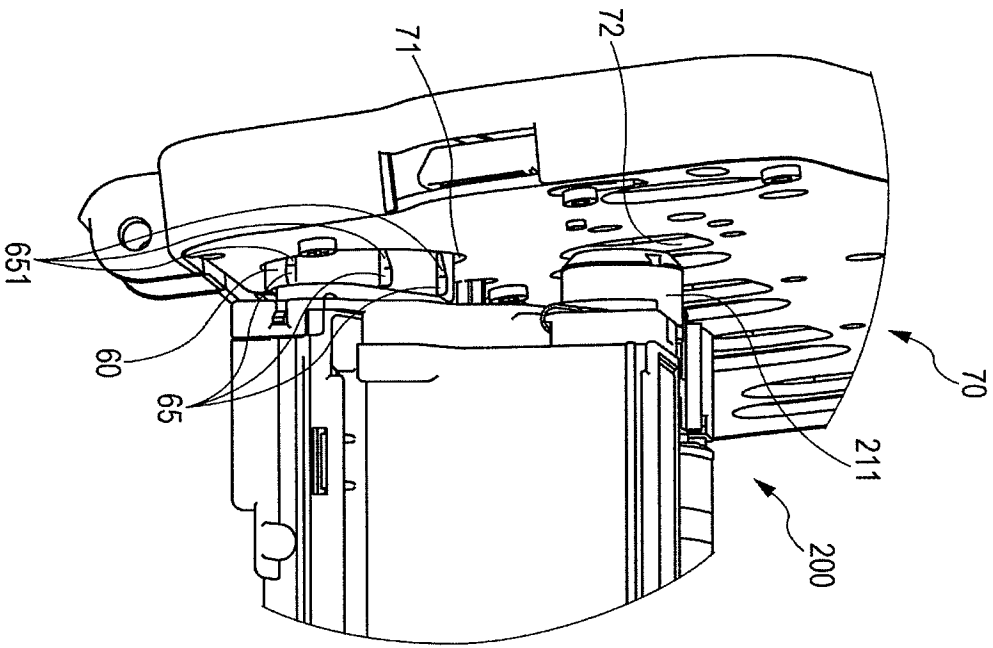
FIG. 15 illustrates the positional relationship between the cap and the interference avoiding hole and the positional relationship between the bearing of the photoconductor and the bearing support hole when the front covering is being closed.

FIG. 15 illustrates the state in which the inclined portion 651 on each outer rib 65 of the cap 60 starts to enter the interference avoiding hole 71. Since the inclined portion 651 is formed on each outer rib 65, the cap 60 is still not in contact with the wall surface of the interference avoiding hole 71 in this state.

Figure 16:
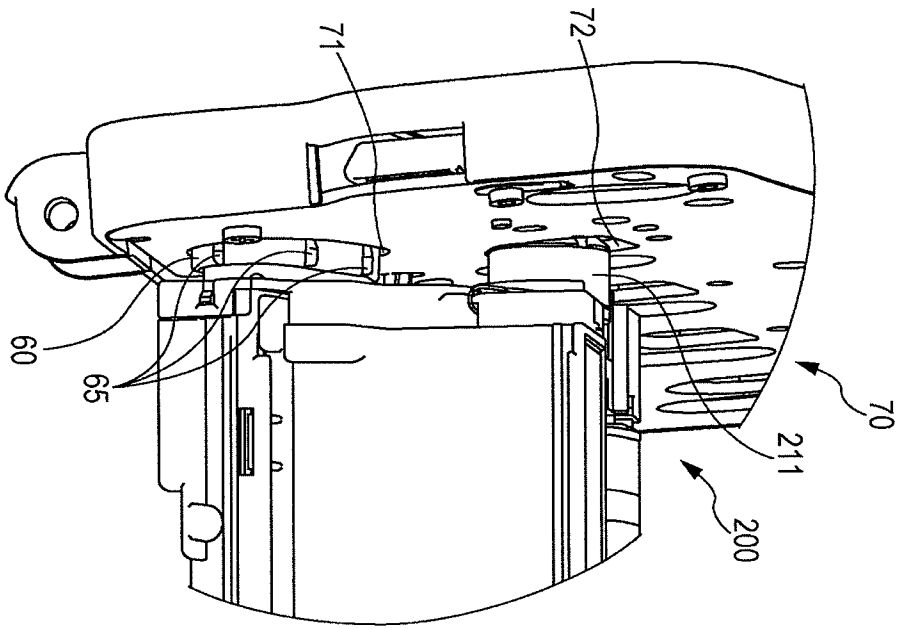
FIG. 16 illustrates the positional relationship between the cap and the interference avoiding hole and the positional relationship between the bearing of the photoconductor and the bearing support hole when the front covering is being closed.

FIG. 16 illustrates the state in which the bearing 211 of the photoconductor 21 starts to enter the bearing support hole 72. When the bearing 211 of the photoconductor 21 starts to enter the bearing support hole 72, the bearing 211 comes into contact with the wall surface of the bearing support hole 72 and the front end of the entire image forming unit 200 including the photoconductor 21 and the developing device 23 is raised. Also in this state, the cap 60 is not in contact with the wall surface of the interference avoiding hole 71.

Figure 17:
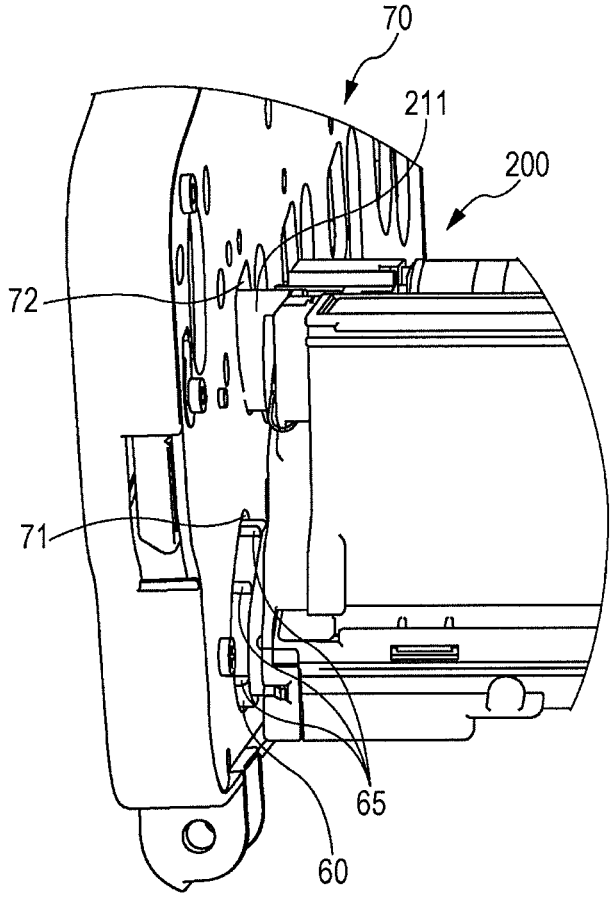
FIG. 17 illustrates the positional relationship between the cap and the interference avoiding hole and the positional relationship between the bearing of the photoconductor and the bearing support hole when the front covering is being closed.

FIG. 17 illustrates the state in which the bearing 211 of the photoconductor 21 is entering the bearing support hole 72. The cap 60 is not in contact with the wall surface of the interference avoiding hole 71.

Figure 18:
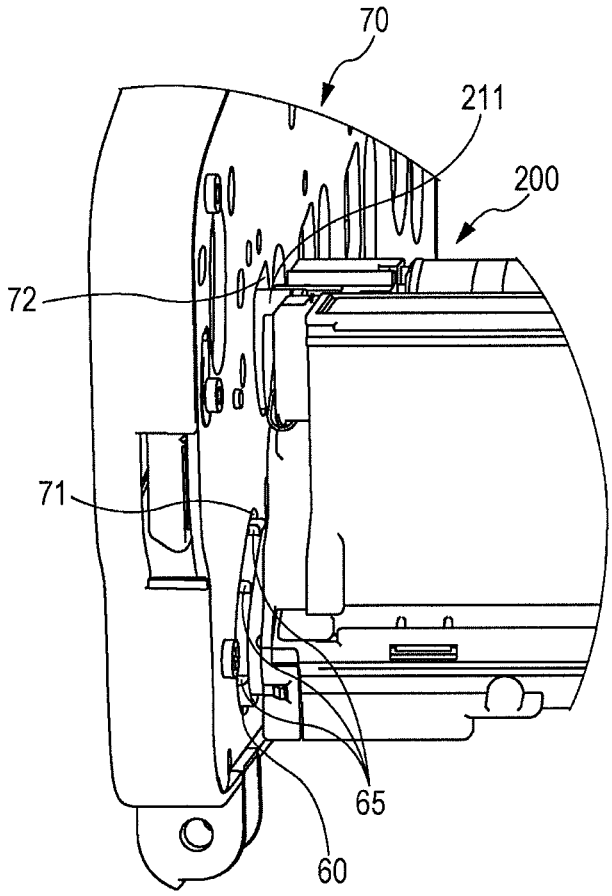
FIG. 18 illustrates the positional relationship between the cap and the interference avoiding hole and the positional relationship between the bearing of the photoconductor and the bearing support hole when the front covering is being closed.

FIG. 18 illustrates the state in which the bearing 211 of the photoconductor 21 is completely inserted in the bearing support hole 72. The cap 60 is not in contact with the wall surface of the interference avoiding hole 71.

As described above, according to the present exemplary embodiment, the position and inclination of each inclined portion 651 are determined so that the front covering 70 may be closed without causing the outer ribs 65 on the cap 60 to come into contact with the wall surface of the interference avoiding hole 71 as long as the dimensions of the cap 60 and the interference avoiding hole 71 and the attachment accuracy of the components are normal. Although the actual product has dimensional errors and attachment errors, the inclined portions 651 are formed such that, even when such errors occur, the cap 60 is prevented from coming into contact with the wall surface of the interference avoiding hole 71 before the bearing 211 of the photoconductor 21 comes into contact with the wall surface of the bearing support hole 72 and the photoconductor 21 is supported by the front covering 70.

As described above, owing to the inclined portions 651, the front covering 70 may be opened and closed with a small force.

According to the above-described printer 100, the cap 60 is attached to the image forming unit 200 without removing the image forming unit 200 from the printer 100 after the operation test performed before shipping. Thus, the printer 100 may be transported without, for example, being stained with the developer.

In the present exemplary embodiment, the front covering 70 is closed in the state in which the cap 60 is attached to the projecting portion 238. However, the cap 60 may be placed in the interference avoiding hole 71 and the front covering 70 may be closed in that state. In such a case, the characteristics of the shapes of the inner ribs and the outer ribs of the cap are reversed.

In addition, although the cap 60 is resin molded according to the present exemplary embodiment, the cap 60 may be formed of an elastic body, such as foam or urethane, or various metals.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming assembly including an image carrier on which a latent image is formed while the image carrier is rotated and which carries a toner image formed by developing the latent image, the image carrier including a support portion that is supported and that projects at a first end of the image forming assembly in a rotation-axis direction, and a developing device that is urged toward the image carrier so as to be near the image carrier and develops the latent image on the image carrier with toner, the developing device including a projecting portion that projects at the first end;

an image forming apparatus body including a frame into which the image forming assembly is installed in a direction such that the first end is the trailing end and that supports the image forming assembly, and an assembly covering member that is rotatably supported by the frame and that rotates between a closed state in which the assembly covering member covers the first end of the image forming assembly supported by the frame and an open state in which the first end of the image forming assembly is exposed, the assembly covering member having a support hole that receives and supports the support portion in the closed state and an interference avoiding hole that receives the projecting portion so as to avoid an interference with the projecting portion in the closed state and that is shaped such that a gap is formed along the entire periphery around the projecting portion in the closed state, wherein the image forming apparatus body transfers the toner image formed by the image forming assembly supported by the frame onto a recording medium and fixes the toner image to the recording medium; and a vibration reducing member that reduces vibration of the developing device relative to the image carrier by being fitted in the gap around the projecting portion in the interference avoiding hole in the state in which the projecting portion of the image forming assembly installed in the frame is inserted in the interference avoiding hole in the assembly covering member in the closed state, wherein the image forming apparatus is operated in the state in which the vibration reducing member is removed.

2. The image forming apparatus according to claim 1, wherein the vibration reducing member includes a base portion that surrounds the projecting portion along the entire periphery of the projecting portion in the gap around the projecting portion in the interference avoiding hole in such a manner that the base portion is separated from both the projecting portion and a wall surface of the interference avoiding hole, an inner projection that projects inward from the base portion toward the projecting portion, and an outer projection that projects outward from the base portion toward the wall surface of the interference avoiding hole.

3. The image forming apparatus according to claim 2, wherein the outer projection includes an inclined portion at an end of the outer projection that is opposed to the assembly covering member when the assembly covering member is rotated from the open state to the closed state while the vibration reducing member is fitted to the projecting portion, the inclined portion being inclined in a manner such that the amount of projection from the base portion decreases toward the end, and wherein the inclined portion is formed so as to prevent the outer projection from coming into contact with the wall surface of the interference avoiding hole before the support portion comes into contact with a wall surface of the support hole when the assembly covering member is rotated from the open state to the closed state.

4. The image forming apparatus according to claim 3, wherein the outer projection is narrower than the inner projection when viewed in the rotation-axis direction and projects outward from the base portion to a position such that a gap is at least partially provided between the wall surface of the interference avoiding hole and the vibration reducing member.

5. The image forming apparatus according to claim 2, wherein the outer projection is narrower than the inner projection when viewed in the rotation-axis direction and projects outward from the base portion to a position such that a gap is at least partially provided between the wall surface of the interference avoiding hole and the vibration reducing member.

6. The image forming apparatus according to claim 1, wherein the outer projection includes an inclined portion at an end of the outer projection that is opposed to the assembly covering member when the assembly covering member is rotated from the open state to the closed state while the vibration reducing member is fitted to the projecting portion, the inclined portion being inclined in a manner such that the amount of projection from the base portion decreases toward the end, and wherein the inclined portion is formed so as to prevent the outer projection from coming into contact with the wall surface of the interference avoiding hole before the support portion comes into contact with a wall surface of the support hole when the assembly covering member is rotated from the open state to the closed state.

7. The image forming apparatus according to claim 6, wherein the outer projection is narrower than the inner projection when viewed in the rotation-axis direction and projects outward from the base portion to a position such that a gap is at least partially provided between the wall surface of the interference avoiding hole and the vibration reducing member.

8. The image forming apparatus according to claim 1, wherein the outer projection is narrower than the inner projection when viewed in the rotation-axis direction and projects outward from the base portion to a position such that a gap is at least partially provided between the wall surface of the interference avoiding hole and the vibration reducing member.

9. A vibration reducing member for an image forming apparatus including an image forming assembly and an image forming apparatus body, wherein the image forming assembly includes an image carrier on which a latent image is formed while the image carrier is rotated and which carries a toner image formed by developing the latent image, the image carrier including a support portion that is supported and that projects at a first end of the image forming assembly in a rotation-axis direction, and a developing device that is urged toward the image carrier so as to be near the image carrier and develops the latent image on the image carrier with toner, the developing device including a projecting portion that projects at the first end, wherein the image forming apparatus body includes a frame into which the image forming assembly is installed in a direction such that the first end is the trailing end and that supports the image forming assembly, and an assembly covering member that is rotatably supported by the frame and that rotates between a closed state in which the assembly covering member covers the first end of the image forming assembly installed in the frame and an open state in which the first end of the image forming assembly is exposed, the assembly covering member having a support hole that receives and supports the support portion in the closed state and an interference avoiding hole that receives the projecting portion so as to avoid an interference with the projecting portion in the closed state and that is shaped such that a gap is formed along the entire periphery around the projecting portion in the closed state, wherein the image forming apparatus body transfers the toner image formed by the image forming assembly installed in the frame onto a recording medium and fixes the toner image to the recording medium, wherein the vibration reducing member is arranged in the gap around the projecting portion in the interference avoiding hole in the state in which the projecting portion of the image forming assembly installed in the frame is inserted in the interference avoiding hole in the assembly covering member in the closed state, the vibration reducing member being removed from the image forming apparatus when the image forming apparatus is operated, and wherein the vibration reducing member comprises:

a base portion that surrounds the projecting portion along the entire periphery of the projecting portion in such a manner that the base portion is separated from both the projecting portion and a wall surface of the interference avoiding hole;

an inner projection that projects inward from the base portion toward the projecting portion; and an outer projection that projects outward from the base portion toward the wall surface of the interference avoiding hole.

* * * * *